United States Patent [19]

Compton

[11] Patent Number: 4,487,376

[45] Date of Patent: Dec. 11, 1984

[54] HOLDER FOR ROLL OF PAPER TOWELS

[76] Inventor: Fred A. Compton, 513 McGee St., Graham, N.C. 27253

[21] Appl. No.: 477,165

[22] Filed: Mar. 21, 1983

[51] Int. Cl.[3] ..... B65H 19/00

[52] U.S. Cl. ..... 242/55.54; 225/79

[58] Field of Search ..... 242/55.54, 55.2, 129.5, 242/129.7, 129.71, 129.8, 139, 156.1; 225/46, 51, 79; 211/44, 45; D6/87, 89, 99, 100, 101

[56] References Cited

U.S. PATENT DOCUMENTS

D. 161,985 2/1951 Woodworth ..... D6/99
3,162,390 12/1964 Meyer ..... 242/55.54
3,767,136 10/1973 Krausse et al. ..... 242/156
4,012,007 3/1977 Cunningham ..... 242/55.54
4,030,676 6/1977 Bardsley ..... 242/55.54

*Primary Examiner*—Leonard D. Christian
*Attorney, Agent, or Firm*—Charles R. Rhodes; Judith E. Garmon

[57] ABSTRACT

A support for conventional roll of perforated paper towelling includes a base for mounting on a vertical or horizontal surface, a support rod perpendicular to said base for holding the towel roll, and a manually operable braking device for impeding the unrolling of the towels when one is being torn off the roll.

4 Claims, 2 Drawing Figures

HOLDER FOR ROLL OF PAPER TOWELS

BACKGROUND AND SUMMARY OF PRESENT INVENTION

Prior art devices for supporting a conventional roll of paper towels are numerous. U.S. Pat. Nos. numbered 3,806,057; 4,030,676; and 2,917,249 all illustrate types of holders designed primarily for domestic use. U.S. Pat. No. 4,030,676 discloses a domestic type of holder which includes an annular rim into which the towels are seated, and which rim is supposed to facilitate the tearing off of an individual towel by providing a fulcrum point for the lower edge thereof. Nothing is mentioned about preventing rotation of the roll while the outermost towel is torn away. Further, the annular rim creates a limitation on the size of the roll of towels which can be effectively maintained on the holder. If the roll size is not compatible, the rim is not effective as an aid for tearing off towels because the towel roll will not fit within the rim. Additionally, as towels are removed and the roll diameter decreases, the holder will become cumbersome and unsteady during the removal of towels.

The present invention, however, overcomes all these disadvantages, and has the further advantage of being adaptable to horizontal or vertical use. The preferred embodiment of the improved towel holder includes a flattened base member, a support rod extending perpendicularly from the approximate center of the base, and a control knob having a flanged base and removably mounted in a bore which extends axially into the center of the support rod.

The control knob, when depressed by the operator's free hand, acts as a braking means to inhibit the rolling motion of the towel roll when towels are being torn from the roll. The control knob is comprised of an upper decorative portion; a flanged base portion with a flat bottom which has an outer diameter generally greater than the outer diameter of the tubular core of the paper towel roll; and an elongated shaft extending perpendicularly from the underside of the base portion. The shaft is designed to fit loosely within the bore in the support rod to operate as described below.

It is, therefore, an object of the present invention to provide an improved holder for conventional rolls of paper towelling. Additional objectives include the provision of a towel holder having means to brake or inhibit the rolling motion of the towels when one is being torn away, and a holder adaptable for use on a vertical or horizontal surface. Other advantages and objectives will become apparent from a study of the detailed description in conjunction with the accompanying drawings, of which:

FIG. 1 is a perspective view of a preferred embodiment of the invention; and FIG. 2 is an exploded perspective of the embodiment shown in FIG. 1.

DETAILED DESCRIPTION OF A PREFERRED EMBODIMENT

Figure 1:
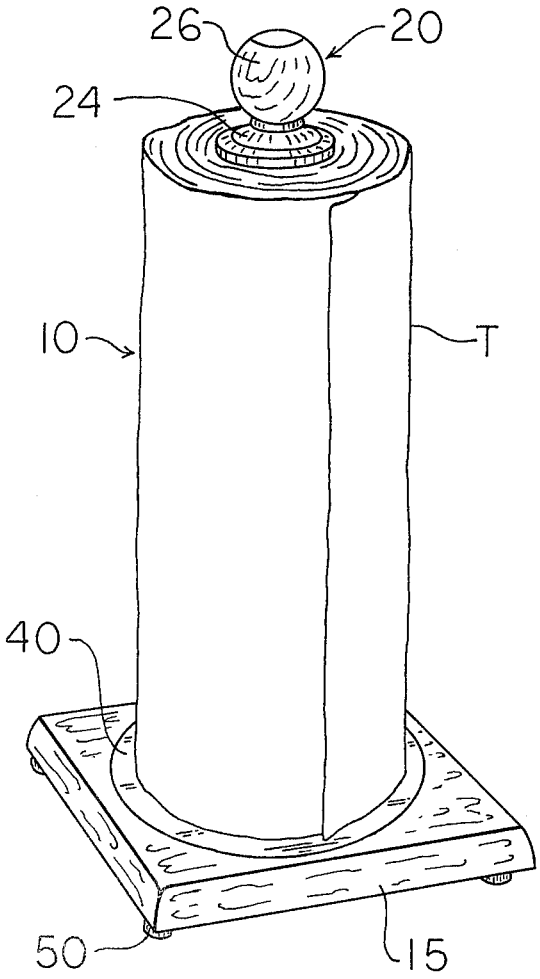

Looking first at FIG. 1, the improved towel holder 10 is shown as it would be used on a horizontal countertop or other such horizontal surface. There is a base 15 and a control knob 20. The towel roll T is supported on a support rod 30 not visible in FIG. 1. The holder 10 is adapted for use on the illustrated horizontal surface or may be mounted with screws on a vertical wall such that the towel roll T is perpendicular to the vertical surface.

Figure 2:
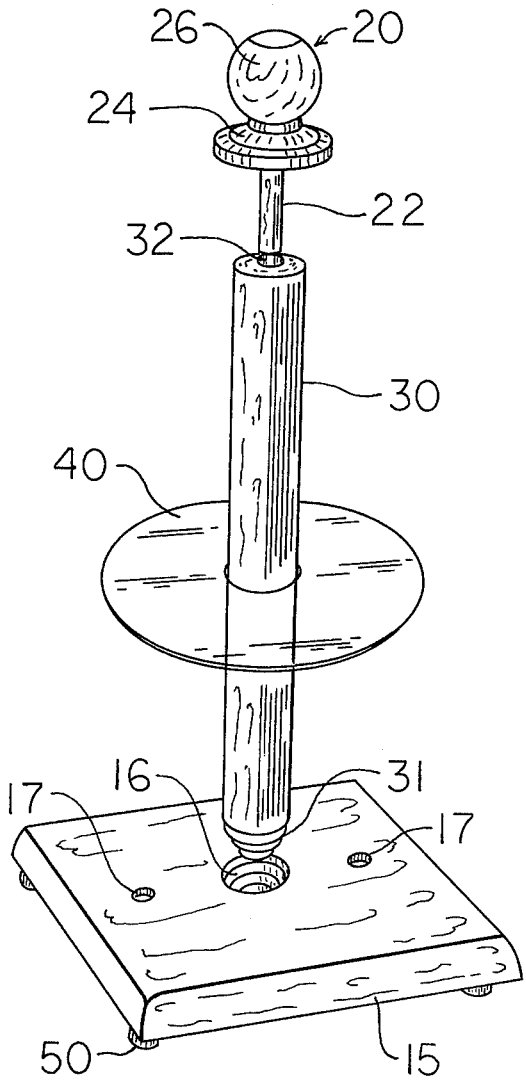

FIG. 2 shows the components of the holder 10 in exploded view, which further includes the support base 15, control knob 20, towel support rod 30 and a cushion glide 40. The support base 15 and the towel support rod 30 are separable for packing and storage. In the preferred embodiment rod 30 includes a threaded lower end 31 which screws into a threaded aperture 16 in the center of base 15. Other conventional means for attaching the rod 30 to the base 15 include metal screws, bolts, etc. By having separable components the holder is compact for efficient and economical packaging for sale and/or storage when disassembled.

The aforementioned means for braking or inhibiting the rolling tendency of the towels during tearing includes the control knob 20 which is operatively engaged with the support rod 30. The engagement of the two components is accomplished by an elongated shaft or pin 22 which extends perpendicularly and downwardly from the underside of the base plate 24 of the control knob. The shaft is loosely inserted into an axially extending bore 32 in the upper end of rod 30.

The control knob itself comprises a decorative upper portion 26 which is attached to the upper surface of base plate 24. The base plate 24 includes a flat undersurface. As previously mentioned, the base plate 24 has an outer diameter greater than the diameter of the tubular core of the towel roll T. The shaft 22 on the undersurface of the base plate should be somewhat shorter than the axial bore 32 in the towel support rod. Thus structured, when the control knob 20 is removed from the support rod, a roll of towels T can be inserted onto the rod, and the control knob shaft 22 reinserted into bore 32.

In operation, when towels are needed, the desired length is unrolled and, using the opposite hand, the control knob 20 is depressed downwardly against the paper towels to a point where the undersurface of base plate 24 bears slight pressure against the end surface of the towel roll. The slight pressure is sufficient to prevent unrolling, and the desired length of towels can be easily torn away at the perforations, and the control knob released.

The cushion glide 40 is formed of a smooth plastic material, or may be a teflon coated surface, positioned between the base 15 and the roll of towels T. The glide decreases friction between towels T and base 15 to allow for ease in unrolling towels. If the holder is made from a plastic material or some material smoother than a wood surface, it may be possible to eliminate the cushion glide 40.

Legs 50 are attached to the undersurface of base 15 to help prevent slipping on a counter surface. The legs 50 are preferably formed of a silicone material which is particularly effective at gripping a smooth surface such as a cabinet or countertop. If it is desired to mount the holder on a wall or other vertical surface, the base 15 is mounted with screws or nails through apertures 17 to the desired wall or surface. Operation of the holder is otherwise the same.

The decorative configuration shown in purely aesthetic. Other shapes and designs may be employed without departing from the scope of the claims below.

What is claimed is:

1. A towel holder for a conventional roll of perforated paper towels which are rolled on a hollow tubular core, said holder comprising:

(a) a base member having a substantially flat upper surface and an under surface which is adapted for use on a horizontal or vertical support surface;

(b) a towel support rod extending perpendicularly from the approximate center of said base and adapted to receive thereon said hollow tubular core; said support rod including a elongated bore extending a prescribed distance axialy into the end of said rod opposite said base member;

(c) braking means for selectively impeding the normal rolling tendency of said core as a towel is being torn therefrom comprising a plate member positioned adjacent the end of said tubular core opposite said base member and means for permitting selective axial movement of said plate member toward said base member to provide a compressive force in a direction along the axis of said tubular core to permit pressure to be brought to bear against the ends of said roll of paper towels;

(d) said brake means further including a control knob having an upper portion and a lower base plate larger in diameter than the tubular core of said towel roll; a shaft extending perpendicularly to the undersurface of said base plate for insertion into said elongated bore into said support rod; and said shaft being of a dimension such that it fits loosely into said bore and is of a length slightly less than said bore;

whereby a roll of paper towelling is placed on said support shaft with one end of said roll seated on said base, and said shaft of said control knob is inserted loosely into said axial bore such that when it is desired to remove a towel, the towels are rolled off to the desired length, the control knob base plate is depressed against the end of the towel roll to prevent further unrolling of the towels, and the towels are torn off along the perforated point.

2. A holder for a roll of paper towels according to claim 1, and further including said base, said support rod, and said braking means, being separable for packaging or storage.

3. A holder for paper towels according to claim 2 further including a friction-resistant glide positioned between said base and the end of said roll of towelling to decrease friction between said base and said towelling and thereby facilitate the unrolling of said towelling.

4. A holder according to claim 3 wherein said friction-resistant glide is formed of a smooth plastic material.

* * * * *